US006104130A

United States Patent [19]

Below

[11] Patent Number: 6,104,130

[45] **Date of Patent: *Aug. 15, 2000**

[54] RADIAL GAP HIGH THREAD SPARK PLUG

[75] Inventor: Matthew B. Below, Findlay, Ohio

[73] Assignee: AlliedSignal Inc., Morristown, N.J.

[ * ] Notice: This patent is subject to a terminal disclaimer.

[21] Appl. No.: 08/951,022

[22] Filed: Oct. 15, 1997

Related U.S. Application Data

[63] Continuation-in-part of application No. 08/603,004, Feb. 16, 1996, Pat. No. 5,697,334.

[51] Int. Cl.[7] ..... H01T 13/20; H01T 13/22; H01T 13/34; H01T 13/36

[52] U.S. Cl. ..... 313/141; 313/135; 313/143; 313/144; 313/145; 123/169 EL; 123/169 MG

[58] Field of Search ..... 313/118, 122, 313/125, 135, 139, 141, 142, 143, 145; 123/169 EL, 169 E, 169 PH, 169 MG, 169 R

[56] References Cited

U.S. PATENT DOCUMENTS

| | | | |
|---|---|---|---|
| 2,334,204 | 11/1943 | King | 313/141 |
| 2,453,048 | 11/1948 | Tognola et al. | 313/141 |
| 3,911,307 | 10/1975 | Goto et al. | 313/141 X |
| 4,028,576 | 6/1977 | Wofsey | 313/141 X |
| 5,697,334 | 12/1997 | Below | 123/169 R |

*Primary Examiner*—Nimeshkumar D. Patel
*Assistant Examiner*—Mack Haynes

[57] ABSTRACT

A spark plug having a center electrode with a cylindrical body with a tip at one end and a terminal near the other end with an insulator radially surrounding the center electrode. A ground shield surrounds the insulator and includes a ground electrode near one end, having a portion thereof with an annular opening disposed above and radially separated from the center electrode tip to form a radial spark gap, with a sealing portion disposed between the ground electrode and the other end of the ground shield for sealing the engine combustion chamber from the outside environment when the spark plug is installed. The ground shield can be formed from two parts which are deformed during manufacturing to be in mechanical engagement and securely holding the insulator in place. The spark plug can also have also have an integral or separate retainer for securing the spark plug to the engine.

15 Claims, 3 Drawing Sheets

RADIAL GAP HIGH THREAD SPARK PLUG

CROSS-REFERENCES TO RELATED APPLICATIONS

This application is a continuation-in-part of copending U.S. patent application Ser. No. 08/603,004 titled "Spark Plug with Integral Retainer Nut" filed Feb. 16, 1996 now U.S. Pat. No. 5,697,334 and assigned to the assignee of the present application.

BACKGROUND OF THE INVENTION

1. Field of the Invention

The present invention relates generally to spark plugs for internal combustion engines and more particularly to a spark plug having a radial spark gap and an annular threaded portion for engaging the engine with the spark plug seat which is located between the spark gap and the threaded portion.

2. Description of Prior Art

Traditional spark plug construction includes an annular metal casing having threads near one end and a ceramic insulator extending from the threaded end through the metal casing and beyond the opposite end. A central electrode is exposed near the threaded end and is electrically connected through the insulator interior to a terminal which extends from the opposite insulator end to which a spark plug wire attaches. An "L" shaped ground electrode extends from one edge of the threaded end of the metal casing into axial alignment with the central electrode to define a spark gap therebetween. The force applied to seal the spark plug in the head is the result of torque transmitted by the threaded metal casing, hence, the threaded portion of the metal casing must be sturdy and of substantial size. A portion of the metal casing is formed to be engaged by a socket tool to provide torque to the threaded portion. The threaded portion is located away from the portion which is engaged by the socket tool.

To facilitate the controlled and efficient exhaust of gases from a combustion chamber, the valves are sometimes increased in size. This may necessitate a decrease in the size of the spark plug, a reduction in the size and sturdiness of the threaded metal casing end, and, in particular, a decrease in the inside diameter of the metal bore of the spark plug and a decrease in the combustion chamber wall area available to threadedly receive the spark plug.

The decrease in the inside diameter of the metal bore of the spark plug reduces the ability of the spark plug to resist carbon build up and similar deposits reducing ignition efficiency. In my U.S. Pat. No. 5,091,672 I teach a spark plug which reduces the deleterious effect of reducing the spark plug size.

Spark plugs having a radial spark gap are also known. While radial gap spark plugs have been suggested in the past, they typically employ a central insulator which extends through the ground ring. U.S. Pat. No. 4,730,582 teaches a radial spark gap plug wherein the tip of the center electrode extends beyond the end of the ground electrode.

SUMMARY OF THE INVENTION

According to the present invention a spark plug is formed with a center electrode disposed in a center insulator which is surrounded for a portion of its length by a ground shield with a ground electrode projecting from one end and having a circular opening formed therein to define with respect to the center electrode a radial spark gap. The center electrode includes a tip which is the sparking surface and which does not project through the circular opening but ends within or slightly beneath the bottom of the circular opening formed through the ground electrode. A threaded portion is formed at the end of the ground shield opposite the ground electrode and a sealing portion is disposed therebetween for being in sealing engagement with the engine combustion chamber when the spark plug is installed. The threaded portion includes means for being engaged by a socket tool to screw the threaded portion into mating threads formed in a bore which communicates with a combustion chamber of an internal combustion engine. This construction provides a unified spark plug body and integral retainer so that during removal of the spark plug, the shell seat moves away from the mating seat portion of the head bore in a helical pattern assuring continuous alignment of the shell and any surrounding carbon or other deposits. The spark plug seat moves away from the head axially while also moving radially as the spark plug is unscrewed and the entire spark plug structure is axially backed out the length of the retainer threads, thereby enhancing ease of removal of the spark plug. Moreover, the present invention achieves these solutions while retaining many of the advantageous features of my earlier patent such as minimizing the likelihood of cross-threading of the retaining nut within the cylinder head.

In accordance with another form of the invention, a spark plug, located in a generally cylindrical opening or bore which communicates with a combustion chamber of an internal combustion engine, has a ground shield with a threaded portion and a generally frustoconical seat portion. The spark plug includes a center electrode having a cylindrical body with a tip at one end and a terminal near the other end. An insulator radially surrounding the center electrode has a substantially cylindrical body with at least first and second diameter sections separated by a shoulder. The ground shield which surrounds the insulator first diameter section has near one end a frustoconical section juxtaposed with the insulator shoulder and a ground electrode extending from the other end having a portion which includes an annular opening and which is aligned with the center electrode tip to define therewith a radial spark gap. There is an annular retainer surrounding the insulator second diameter section which includes a threaded portion engaging the threaded portion of the bore and a frustoconical portion overlapping and collapsed around the ground shield frustoconical section and juxtaposed insulator shoulder securing the ground shield and retainer together as a unit with the insulator captured therebetween.

In accordance with another aspect of the invention, a radial spark gap is achieved in a spark plug generally of the type discussed by providing a ground shield which surrounds the insulator first diameter section and includes near one end a frustoconical section juxtaposed with an insulator shoulder and a ground electrode near the other end having a portion including a centrally located aperture positioned radially apart and above the center electrode tip and defining therewith a radial spark gap.

BRIEF DESCRIPTION OF DRAWINGS

For a better understanding of the invention reference may be had to the preferred embodiments exemplary of the inventions shown in the accompanying drawings in which.

DETAILED DESCRIPTION OF THE PREFERRED EMBODIMENTS

Figure 6:
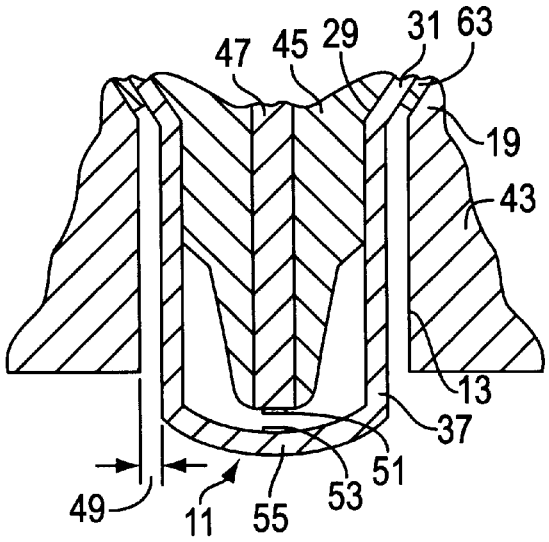
FIG. 6 is a cross-sectional view of a portion of a spark plug incorporating my invention in another form and received in the head of an internal combustion engine.
Figure 7:
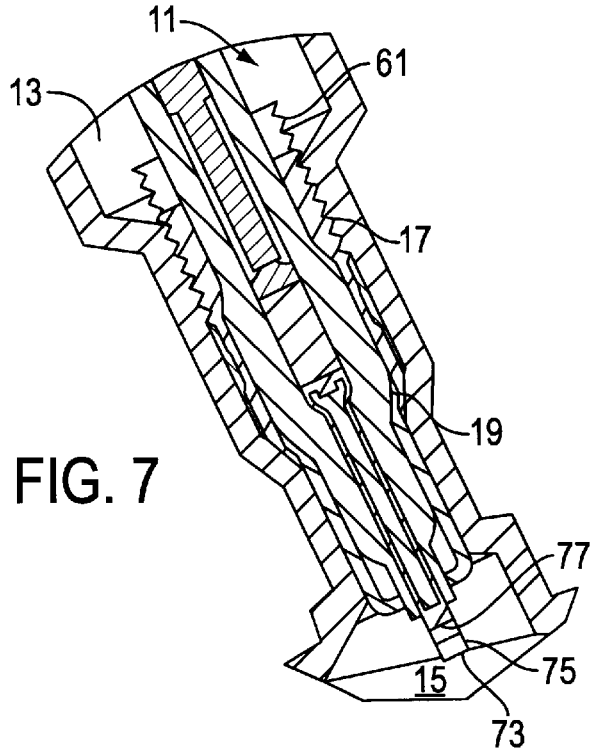
FIG. 7 illustrates a portion of a spark plug showing a still further form of my invention seated in the bore of an internal combustion engine.

In FIGS. 6 and 7, a spark plug 11 is shown in a cylindrical bore or opening 13 which communicates with the combustion chamber 15 of an internal combustion engine. The opening has threads 17 for receiving the spark plug threads 61 and a frustoconical sealing seat 19.

FIGS. 1–5 illustrate a radial spark gap version of the present invention. The spark plug has an axis 10 and a center electrode 21 extending the full axial length of the spark plug. The center electrode 21 has a cylindrical body with a tip 33 at one end and a terminal 23 near the other end. The center electrode 21 includes a longer than conventional center wire 47. A ceramic or similar insulator 41 radially surrounds center electrode 21. The insulator 41 has a substantially cylindrical body with first 25, second 27 and third 67 diameter sections. The second diameter section 27 is located intermediate the first 25 and third 67 diameter sections and the diameter of the second diameter section 27 is greater than that of either of the other two diameter sections 25 or 67. The first diameter section 25 and the second dissimilar diameter section 27 are separated by a shoulder 29; while, a shoulder 69 separates the second diameter section 27 and the third diameter section 67.

Figure 1:
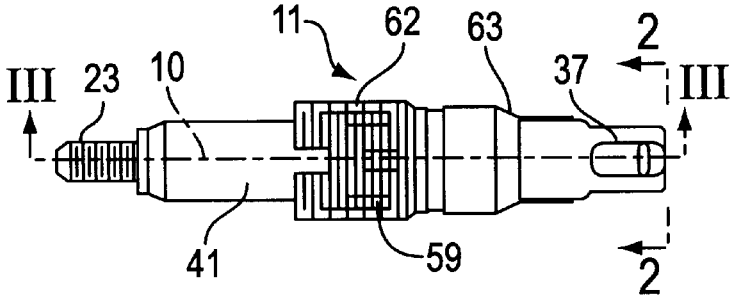
FIG. 1 is a side elevation view of a radial gap spark plug illustrating my invention in one form.
Figure 2:
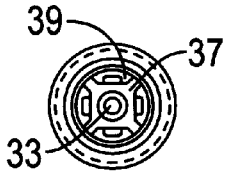
FIG. 2 is an end view of the spark plug of FIG. 1 from the right end thereof showing the radial spark gap.
Figure 3:
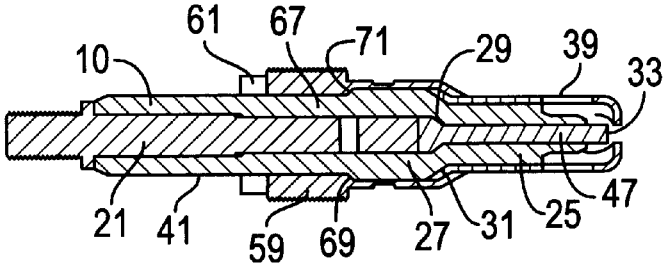
FIG. 3 is a view in cross-section along lines III—III of FIG. 1.
Figure 4:
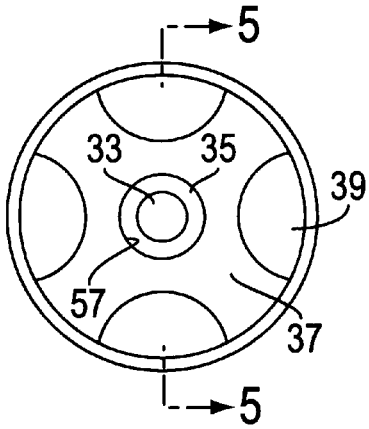
FIG. 4 is a simplified and enlarged end view similar to FIG. 2, but emphasizing the location and spacing of the electrodes
Figure 5:
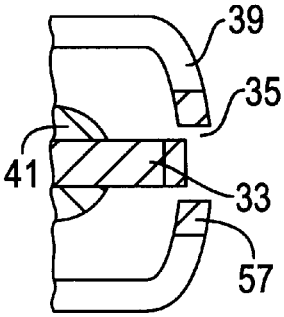
FIG. 5 is a view in cross-section along lines 5—5 of FIG. 4.

A cylindrical shell shaped ground shield 37 surrounds the insulator 41 first diameter section 25 and including near one end a frustoconical section 31 which is juxtaposed with the insulator shoulder 29. There is a ground electrode 57 near the other end having a portion radially aligned with the center electrode tip 33 as best seen in FIGS. 4 and 5. Tip 33 and ground electrode 57 defining a radial spark gap at the bottom of the annulus of opening 35. Tip 33 is disposed radially separated from and within annular opening 35 or slightly below the inside edge of annular opening 35.

An annular retainer 59 such as a nut or a castle head jam screw has a threaded portion 62 surrounding the third insulator section 67 and extends toward the right as viewed to also surround the insulator 41 second diameter section 27. Slots or openings 61 are formed in the exposed top of the threaded portion of retainer 59. A suitable socket tool can engage the slots 61 in the annular retainer 59 for screwing spark plug 11 into and out of engine bore 13. Threaded portion 61, of course, threadedly engages the threaded portion 17 of the generally cylindrical opening 13. The annular retainer 59 has a sidewall thickness in the region of the threaded portion 61 which is substantially greater than the sidewall thickness in the region overlapping the region 27. The annular retainer 59 has a frustoconical portion 63 overlapping the ground shield 37 frustoconical section 31 and juxtaposed insulator shoulder 29 securing the ground shield 37 and retainer 59 together with the insulator 41 captured therebetween. Finally, the annular retainer 59 includes a second frustoconical portion 71 which engages the shoulder 69. The insulator 41 provides a compression transmitting mechanical connection between the retainer 59 and the shield 37 which, when threaded into the engine bore 13, urges the retainer frustoconical portion 31 into engagement with the ground shield frustoconical portion 63 which, in turn, engages the seat portion 19 to establish an electrical ground between the ground shield 37 and engine head while at the same time sealing the combustion chamber 15 from the surrounding environment. When the retainer 59 is threaded into the bore, the retainer flange 63 is, of course, also urged into sealing engagement with the bore seat 19.

The embodiment of FIGS. 1–5 illustrates a radial spark gap between the tip 33 and the bottom of the opening 35 in the ground electrode 57. The partially closed end of the ground shield 37 includes the centrally located aperture 35. Note, as best seen in FIG. 5, the insulator 41 is axially spaced from the aperture while the tip 33 ends beneath aperture 35 and the end of the ground shield 37. Tip 33 can also project into aperture 35 but preferably does not extend beyond aperture 35. The ground shield end portion 57 is thus slightly axially above and radially separated from the center electrode tip 33 to form the radial spark gap.

Figure 11:
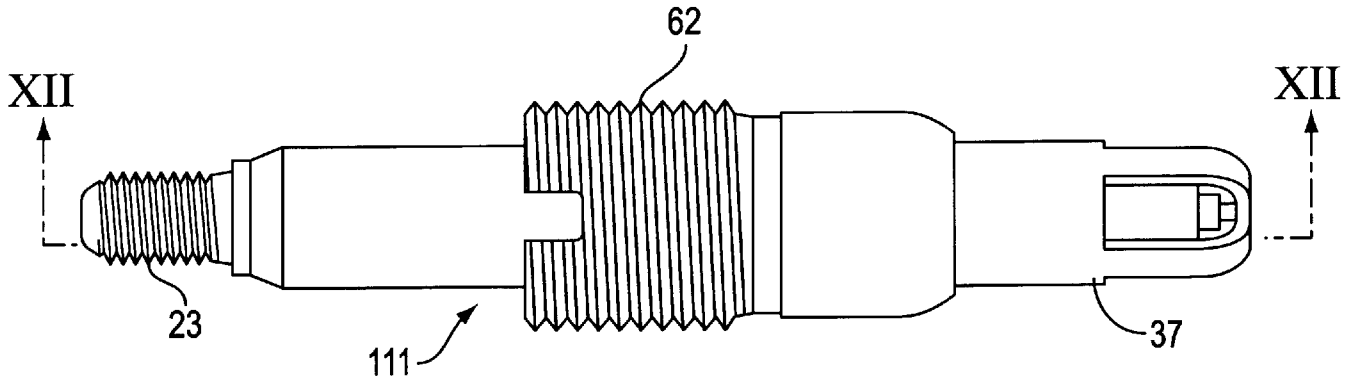
FIG. 11 is an enlarged view of a radial gap spark plug according to the present invention having a fine wire or rivet attached to the end of the center electrode.
Figure 12:
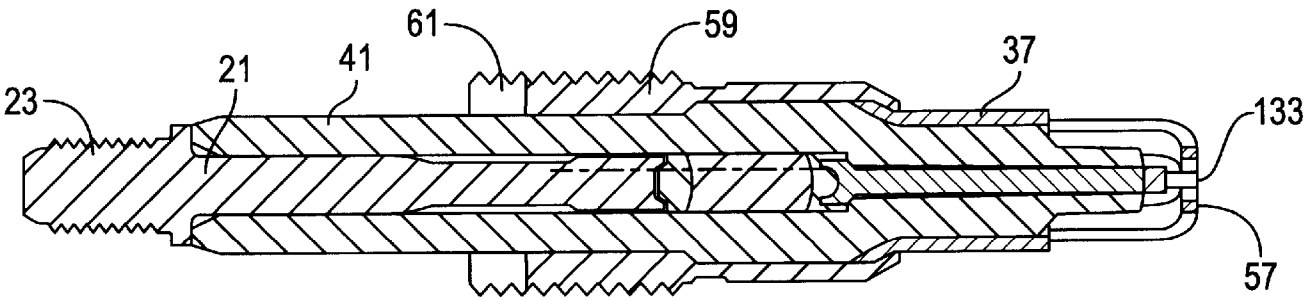
FIG. 12 is a view in cross-section along lines XII—XII in FIG. 11.
Figure 13:
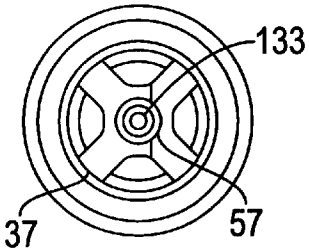
FIG. 13 is a right end view of the spark plug of FIG. 11.

FIGS. 11–13 are enlarged illustrations of a spark plug 111 which is very similar to spark plug 11 shown in FIGS. 1–5 but with a fine wire or rivet tip 133. Tip 133 extends from center electrode 21 and projects into the annular opening defined by the ground electrode 57. Fine tip 133 is formed from a noble metal such as platinum or a noble metal alloy. Tip 133 preferably does not extend beyond the end of ground shield 37. Ground electrode 57 is radially separated from the center electrode tip 133 to form the radial spark gap.

FIG. 6 illustrate formation of an axial spark gap between the tip 51 and ground contact 55. In this embodiment, the ground shield end portion includes a generally U-shaped stirrup 65 which diametrically spans the end shield end and is axially spaced from the center electrode tip 51.

FIG. 6 also illustrates one reason the present invention facilitates spark plug removal as compared to the above noted patented designs. There is initially a small gap 49 between the bore 13 sidewall and the outer cylindrical surface of the ground shield 37. As the engine runs, carbon and other combustion deposits tend to fill this annular gap reducing the clearance between the bore and the spark plug. This reduced clearance necessitates the plug be removed directly axially without any tipping. With a jam nut integral with the remaining spark plug structure, the whole plug is removed in a helical pattern as the nut is unscrewed directly along the axis resulting in negligible tipping and easy removal.

The embodiment of FIGS. 7 represents a substantial saving in the cost of the ground shield portion. By welding the L-shaped electrode 73 to an otherwise open-ended cylindrical ground shield portion, the comparatively complex fabrication of the partially closed end is avoided reducing the cost of the ground shield to about 10% of its former value. In this embodiment, the ground shield end portion includes the generally L-shaped member 73 which has a free end 75 radially aligned with and axially spaced from the center electrode tip 77 to form the spark gap.

The unique technique for fabricating a spark plug in accordance with my invention should now be clear. The insulator 41 or 45 and its included center electrode are axially passed into the cylindrical shell ground shield. In the case of the radial spark gap of FIGS. 1–5, this step of axially passing includes moving the center electrode tip 33 through the aperture 35 and to a position axially aligned with and radially spaced from the shield end 57. The flared frustoconical flange 31 engages the insulator shoulder 29. The cylindrical shell retainer 59 is then axially passed over the insulator from the opposite end and its interior frustoconical ledge 71 engages the insulator second shoulder 69. A portion of the retainer is then radially collapsed about the flange 31 to secure the ground shield and retainer together with the insulator captured therebetween.

Figure 8:
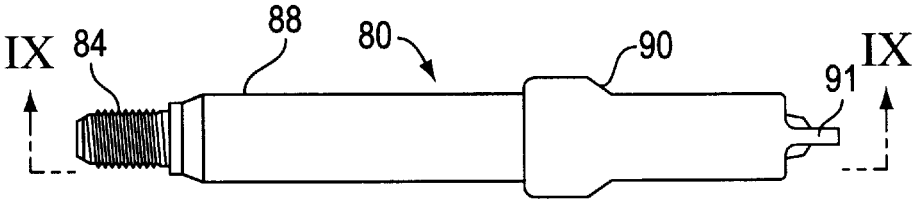
FIG. 8 is a side elevation view of a spark plug, which does not include an integral retainer, according to another embodiment of my invention.
Figure 9:
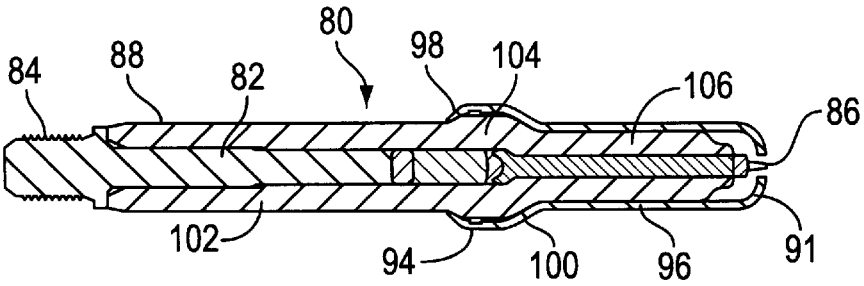
FIG. 9 is a view in cross-section along lines IX—IX of FIG. 8.
Figure 10:
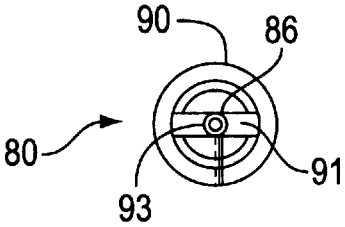
FIG. 10 is a right end view of the spark plug shown in FIG. 8.

Referring now to FIGS. 8, 9 and 10 there is shown a spark plug 80 having a center electrode 82. Spark plug 80 is the type wherein the retainer nut is a separate part. Spark plug 80 has a center insulator 88 with an outside shape similar to shapes of the insulators described above. A bore is formed in insulator 88 for receiving the center electrode 82. The firing end or tip 86 of the center electrode 82 project from insulator 88. The terminal end 84 of center electrode 82 is threaded. The Alumina insulator 88 which surrounds the center electrode 82 has a first diameter section 102, a second diameter section 104 and a third diameter section 106. A first shoulder forms a tapered and smooth transition between the first diameter section 102 and the second diameter section 104. A second shoulder forms a tapered and smooth transition between the second diameter section 104 and the third diameter section 106. A metal shield 90 has a cylindrical body with a first diameter section 94 concentric to the second diameter section 104 of insulator 88 and a second diameter 96 that is concentric with third diameter section 106 of insulator 88. A flange 98 that extends from section 94 of the shield 90 engages the first shoulder on insulator 88. A frustoconical section 100, between the first diameter 94 and the second diameter 96 on the shield 90, engages the second shoulder of insulator 88.

Ground shield 90 has a U-shaped ground electrode 91 extending from its free end. The legs of the U-shaped electrode are attached to the ground shield 90. The bight portion of the U-shaped electrode 91 includes an annular opening 93 which with electrode tip 86 defines a radial spark gap. The tip 86 of center electrode 82 ends within or slightly below the annular opening 93.

In the above radial spark gap embodiments the electrode tip 86 position is optimized to reduce the required voltage and maximize gap life. Prior art radial gap spark plugs have the center electrode sticking out beyond the end of the ground shield. This configuration causes the required voltage to be higher and increases the temperature of the center electrode. The tip 86 of the center electrode 82 in the present invention ends inside or slightly below the annular hole 93 in the ground shield 90. This position reduces the required voltage and reduces the electrode 91 temperature. The center electrode tip 86 can also use platinum or other noble metal enhancements.

What is claimed is:

1. A spark plug for an internal combustion engine comprising:

a center electrode having a terminal at one end and a tip at the other end;

an insulator disposed around said center electrode;

a ground shield disposed around and attached to a portion of said insulator having a threaded portion on one end and a ground electrode extending from the other end;

said electrode having an annular opening formed therein which is positioned with the outside of the annular opening slightly above the tip of said center electrode to define a radial spark gap with respect to the tip of said center electrode;

wherein the threaded portion of said ground shield includes slots which can be engaged by a tool for installing and removing the spark plug from the engine.

2. A spark plug as claimed in claim 1 wherein said ground shield is formed from a first part which includes the threaded portion and a second part which includes the ground electrode; and, said first part and said second part fit around said insulator and are deformed during manufacturing to be in mechanical engagement with each other and with said insulator to secure said first part, said second part and said insulator together as an unitary assembly and against any relative movement.

3. A spark plug as claimed in claim 2 wherein the threaded portion is formed with a configuration which can be engaged by a tool for installing and removing the spark plug.

4. A spark plug as claimed in claim 3 wherein the configuration is a plurality of axially extending slots formed in the threaded portion.

5. A spark plug located in a generally cylindrical spark plug receiving bore in an internal combustion engine, the bore communicating with a combustion chamber of the internal combustion engine and including a threaded portion and a seat portion which is located closer to the combustion chamber than the threaded portion, the spark plug comprising:

a center electrode having a cylindrical body with a tip at one end and a terminal near the other end;

an insulator radially surrounding the center electrode and having a substantially cylindrical body; and a ground shield surrounding said insulator including near one end a ground electrode having an annular opening formed therein which defines with said center electrode tip a radial spark plug gap; wherein the outside of the annular opening is slightly above and radially spaced from the center electrode tip;

said ground shield has, on the end away from the ground electrode, a threaded portion having threads that are matched with the bore threads, said ground shield has a portion between the threaded portion and the ground electrode which provides a seal between said ground shield and the seat portion of the bore to establish an electrical ground between said ground shield and the engine while at the same time sealing the combustion chamber from the surrounding environment;

said ground shield is formed from a first part which includes the threaded portion and a second part which includes the ground electrode; and said first part and said second part fit around said insulator and are deformed during manufacturing to be in mechanical engagement with each other and with said insulator to secure said first part, said second part, and said insulator together as a unitary assembly and against any relative movement.

6. A spark plug as claimed in claim 5 wherein the threaded portion is formed with a configuration which can be engaged by a tool for installing and removing the spark plug.

7. A spark plug as claimed in claim 6 wherein the configuration is a plurality of axially extending slots formed in the threaded portion.

8. A spark plug as claimed in claim 5 wherein the tip of said center electrode has a diameter smaller than the rest of said center electrode and is formed from a noble metal.

9. A spark plug comprising:

an elongated center electrode having a terminal on one end and a tip on the other end;

an insulator disposed radially around said elongated center electrode having a first diameter section separated by a first shoulder from a second diameter section and a third diameter section separated by a second shoulder from the second diameter section with the second diameter section located intermediate the first and third diameter sections and the diameter of the second section being greater than the diameters of the first and third diameter sections;

a cylindrical ground shield, having on one end a ground electrode, formed with an annular opening spaced away from the tip of said center electrode to define therewith a radial spark gap, and a flange disposed around the first diameter section with the flange engaging the first shoulder and an end portion which engages the second shoulder to capture said insulator therebetween.

10. A spark plug as claimed in 9 wherein said ground electrodes are each generally a U-shaped stirrup spanning the free end of said ground shield and axially spaced slightly from the center electrode tip.

11. A spark plug as claimed in claim 9 wherein the tip of said center electrode has a diameter smaller than the rest of said center electrode and is formed from a noble metal.

12. A spark plug according to claim 9 wherein the end portion of said cylindrical ground shield is threaded.

13. A spark plug located in a generally cylindrical spark plug receiving bore in an internal combustion engine, the bore communicating with a combustion chamber of the internal combustion engine and including a threaded portion and a seat portion, the spark plug comprising;

a center electrode having a cylindrical body with a tip at one end and a terminal near the other end;

an insulator radially surrounding the center electrode and having a substantially cylindrical body with at least first and second diameter sections separated by a shoulder;

a ground shield surrounding said insulator first diameter section and including near one end a section located proximate the insulator shoulder and a ground electrode extending from the other end having a portion thereof including an annular opening which is spaced axially further away from said insulator than the tip to define with the center electrode tip a radial spark gap; and an annular retainer surrounding said insulator second diameter section and including a portion having threads that are matched with the bore threads, the annular retainer providing a seal between the ground shield and the seat portion of the bore to establish an electrical ground between the shield and the engine while at the same time sealing the combustion chamber from the surrounding environment.

14. A spark plug as claimed in claim 13 wherein the tip of said center electrode has a diameter smaller than the rest of said center electrode.

15. A spark plug as claimed in claim 13 wherein the tip of said center electrode is formed from a noble metal.

* * * * *